US006313447B1

(12) United States Patent
Steiner et al.

(10) Patent No.: US 6,313,447 B1
(45) Date of Patent: Nov. 6, 2001

(54) COOK TOP POSITIONING ELEMENT FOR A HEATING DEVICE

(75) Inventors: Herbert Steiner, Traunstein; Georg Brandl, Palling; Markus Theine, Freilassing; Thomas Stein, Hörlkofen, all of (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/449,720

(22) Filed: Nov. 24, 1999

(30) Foreign Application Priority Data

Nov. 24, 1998 (DE) ..... 198 54 230

(51) Int. Cl.[7] ..... H05B 3/68
(52) U.S. Cl. ..... 219/462.1; 219/452.12
(58) Field of Search ..... 219/451.1, 452.11, 219/452.12, 454.12, 456.1, 462.1; 126/211, 214 A, 214 C, 39 B; 99/378, 422, 449

(56) References Cited

U.S. PATENT DOCUMENTS 3,632,983 * 1/1972 Dills ..... 219/452.12
4,363,956 * 12/1982 Schneider et al. ..... 219/452.12
4,788,414 * 11/1988 Schreder ..... 219/452.12
5,571,434 * 11/1996 Cavener et al. ..... 219/452.12
5,847,364 * 12/1998 White et al. ..... 219/452.12

FOREIGN PATENT DOCUMENTS 86 15 030 9/1986 (DE) .
0 610 817 A1 8/1994 (EP) .
0 663 566 A1 7/1995 (EP) .

* cited by examiner

*Primary Examiner*—Sang Paik
(74) *Attorney, Agent, or Firm*—Herbert L. Lerner; Laurence A. Greenberg; Wewrner H. Stemer

(57) ABSTRACT

A cook top with a frame on which there is secured a cook top panel, in particular made of glass ceramic. A plurality of hot plates is provided which can each be heated by a heating element that is secured beneath the cook top panel. For the positioning of the heating element relative to the frame exactly one positioning element is secured on the frame. The positioning element has at least two spaced-apart connecting elements that engage in two corresponding positioning openings of a heating-element casing of the heating element which is to be positioned. In order to achieve high positional accuracy of the heating-element casing with low outlay, the frame has an installation shoulder that extends essentially parallel to the base of the heating-element casing, and the positioning element is secured in a precisely positioned manner on the installation shoulder.

18 Claims, 2 Drawing Sheets

COOK TOP POSITIONING ELEMENT FOR A HEATING DEVICE

BACKGROUND OF THE INVENTION

Field of the Invention:

The present invention relates to a cook top with a rectangular frame on which there is secured a cook top panel, in particular a cook top panel made of a glass ceramic. A plurality of hot plates is provided which can each be heated by a heating element that is secured beneath the cook top panel. For precisely positioning the heating element relative to the frame one positioning element is secured on the frame. The positioning element has at least two spaced-apart connecting elements that engage in two corresponding positioning openings of a heating-element casing of the heating element.

Such a cook top is known from Published, European Patent Application EP 0 663 566 A1, it being possible for the positioning element to be screwed in the positioning openings of the heating-element casing by screws inserted through two corresponding openings. Furthermore, the positioning element has angled insertion sections by which the positioning element can be inserted into corresponding pockets which are provided on the inside of the side wall of the cook top frame. In this case, the positioning element is disposed in a corner region of the cook top frame.

SUMMARY OF THE INVENTION

It is accordingly an object of the invention to provide a cook top with a positioning element for a heating device which overcomes the above-mentioned disadvantages of the prior art devices of this general type, in which the positional accuracy of the heating elements in relation to the cook top frame and/or the cook top panel is improved.

With the foregoing and other objects in view there is provided, in accordance with the invention, a cook top, including:

- a rectangular frame having an installation shoulder;
- a cook top panel having a plurality of hot plates and secured on the rectangular frame;
- a heating element secured beneath the cook top panel for heating the plurality of hot plates, the heating element having a heating element casing with positioning openings formed therein and a base, the installation shoulder of the rectangular frame extending substantially parallel to the base of the heating element casing; and
- a positioning element for positioning the heating element relative to the rectangular frame and secured in a precisely positioned manner on the installation shoulder, the positioning element having at least two spaced-apart connecting elements for engaging in two of the positioning openings of the heating-element casing of the heating element.

This is achieved according to the invention, in the case of a cook top of the generic type, in that the frame has an installation shoulder that extends essentially parallel to the base of the heating-element casing. By use of the installation shoulder, the positioning element is secured in a precisely positioned manner on the installation shoulder. This avoids the prior-art installation pockets that involve high production outlay and are subject to relatively large tolerances. Furthermore, the openings for the positioning of the positioning element in the installation shoulder can be realized particularly precisely relative to installation openings of the installation shoulder for operating and display elements.

In order for it to be possible, in addition to the positioning function, also to fulfil a holding-down function in relation to the heating-element casing, the invention provides for the positioning element to be secured on the frame by at least one screw-connection. The same purpose is served by configuring the positioning element from spring-steel material, the positioning or securing element being clamped onto the base of the heating-element casing during the positioning operation.

According to a preferred embodiment, the positioning element is a narrow elongate plate from which there project two fastening arms with casing hooks which engage in the positioning openings of the heating-element casing. This embodiment makes savings in terms of materials and thus costs, and nevertheless allows a large spacing between the two casing hooks and, associated therewith, high positional accuracy.

In order further to increase the positional accuracy, the positioning element has spaced-apart positioning hooks which engage in the corresponding positioning openings of the installation shoulder of the frame. While the precisely definable positioning openings in the installation shoulder guarantee a precise position of the positioning element relative to the frame, the positioning element is fastened on the frame by a screw-connection that is subject to relatively large tolerances.

In order for it to be possible to provide display and/or operating elements in the corner region of the cook top panel or of the installation frame, the positioning element is secured outside or adjoining the corner region of the frame, in one of the longitudinal sides thereof.

Other features which are considered as characteristic for the invention are set forth in the appended claims.

Although the invention is illustrated and described herein as embodied in a cook top with a positioning element for a heating device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
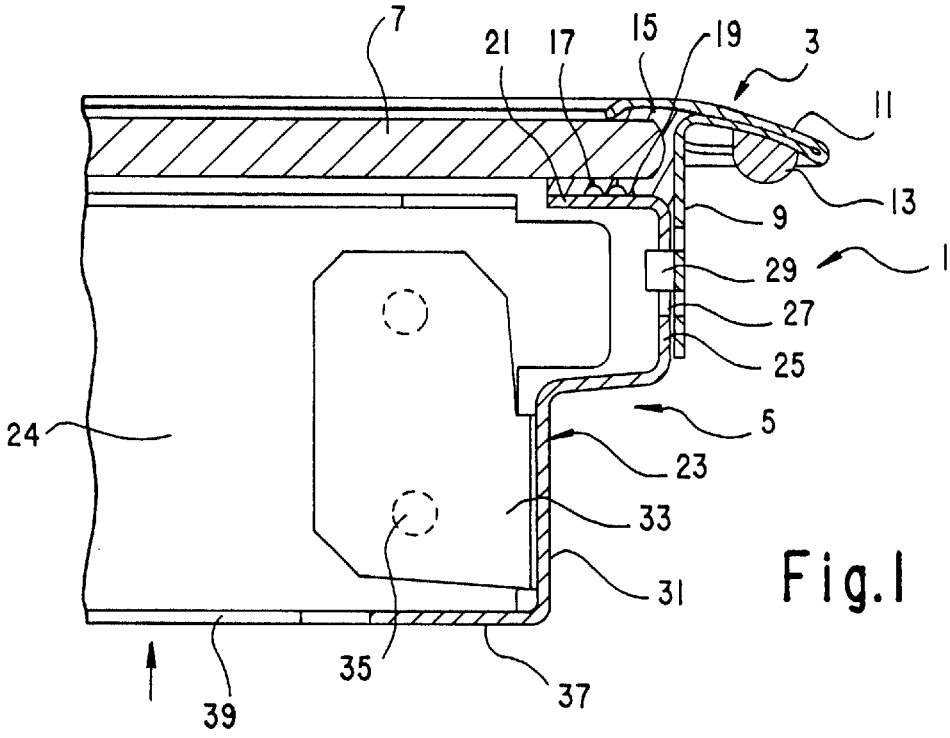
FIG. 1 is a diagrammatic, fragmented, sectional view taken along the line I—I shown in FIG. 3, of a part of a cook top according to the invention.

In all the figures of the drawing, sub-features and integral parts that correspond to one another bear the same reference symbol in each case. Referring now to the figures of the drawing in detail and first, particularly, to FIG. 1 thereof, there is shown a cook top or hob 1 which has a rectangular decorative frame 3 made of a high-grade steel and is connected to a single-piece, rectangular installation frame 5 which is disposed there-beneath and is made of sheet steel.

Figure 3:
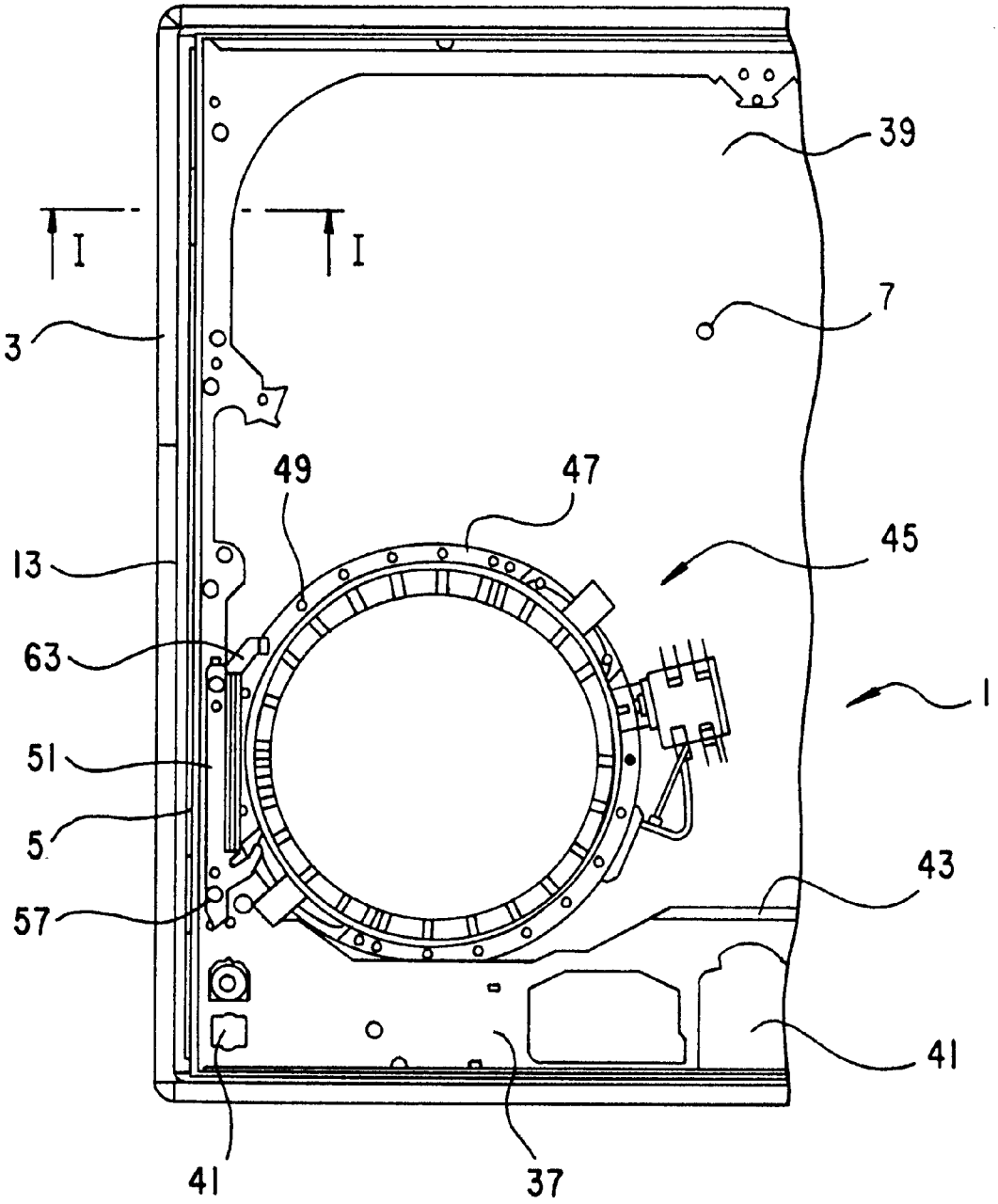
FIG. 3 is a plan view from beneath a cook top panel (directional arrow in FIG. 1), of a part of the cook top with the heating-element installed.

A glass-ceramic panel 7, known per se, of the cook top 1 is secured between the decorative frame 3 and the installation frame 5. On a top side of the glass-ceramic panel 7, are suitable decorative prints which mark the heatable hot plates of the cook top 1 (not shown). The decorative frame 3 is configured in a number of parts and is essentially in the form of a T in profile. A curved decorative-frame cover panel 11 is formed by bending part of a decorative-frame side wall 9 which extends perpendicularly to the glass-ceramic panel 7. A first sealing bead 13 is provided (FIGS. 1, 3) on an underside of a leg-like outer section of the decorative-frame panel 11. The outer section projects in an outward direction away from the glass-ceramic panel 7. By the sealing bead 13, the cook top 1 or the decorative frame 3 rests with suitable sealing, for example, on a correspondingly cut-out work top in a manner known per se (not shown). Furthermore, a second, foamed sealing bead 15 is provided around the periphery in the inter-space between the top side of the glass-ceramic panel 7 and the underside of the inwardly projecting leg-like inner section of the decorative-frame panel 11. The glass-ceramic panel 7 is thus surrounded by the decorative frame 3 and has the latter engaging over it around the periphery by the decorative-frame cover panel 11. A plurality of small elastic adhesive-tape portions 17 are adhesively bonded around the periphery of a border region of the glass-ceramic panel 7, on the underside of the latter. At the same time, in this region, a silicone-adhesive bead 19 is provided around the periphery of the glass-ceramic panel 7 and between the border region of the glass-ceramic panel 7 and the inside of the decorative-frame side wall 9. In addition to fixing the two frame parts 3, 5 and the glass-ceramic panel 7, the adhesive connection 19 also serves for sealing the cook top 1 in this region. The glass-ceramic panel 7 is supported, via the adhesive-tape portions 17, around the periphery on a supporting shoulder 21 which belongs to the installation frame 5 and extends in the form of a frame parallel to the glass-ceramic ceramic panel 7. The supporting shoulders 21 are each bent individually at right angles from four side walls 23, 24 of the rectangular installation frame 5. Rectangular lug openings 27 are punched (FIG. 1) around the periphery in a top wall region 25 of the side walls 23, 24 of the installation frame 5. Rectangular installation lugs 29 which are cut out on three sides from the decorative-frame side wall 9 are bent into the lug openings 27 and positioned therein. In order to simplify the installation of the decorative frame 3 on the installation frame 5, a small gap is provided around the periphery between the decorative-frame side wall 9 and the installation-frame side wall 23. In a bottom wall region 31 of the side wall 23, a connecting lug 33 is bent from the side wall at right angles and perpendicularly to the glass-ceramic panel 7 and thus extends parallel to the adjacent side wall 24 of the installation frame 5. The two side walls 23, 24 are fixed to one another by press joining at locations 35 of the connecting lug 33. This connection in the four corner regions of the installation frame 5 gives the latter its basic stability. At a bottom end section of the bottom wall region 31 of the side walls 23, 24 of the installation frame 5, an installation shoulder 37 is bent at right angles around the periphery and extends parallel to the supporting shoulder 21 and/or to the glass-ceramic panel 7 (FIGS. 1, 3). The installation shoulder 37 surrounds a large-surface-area base cutout 39 and, in addition, has component openings 41 distributed essentially around the periphery (FIGS. 1, 3). In these component openings 41, it is possible to secure components of the cook top 1, for example lighting elements, switches or electronic components, e.g. a residual-heat display unit (not shown). Parallel to the side wall 24 of the installation frame 5, a heat shield 43 is bent at right angles from the installation shoulder 37 in order to provide thermal protection for particularly temperature-sensitive electronic components secured in the component opening 41 beneath the glass-ceramic panel 7 (FIG. 3).

Figure 2:
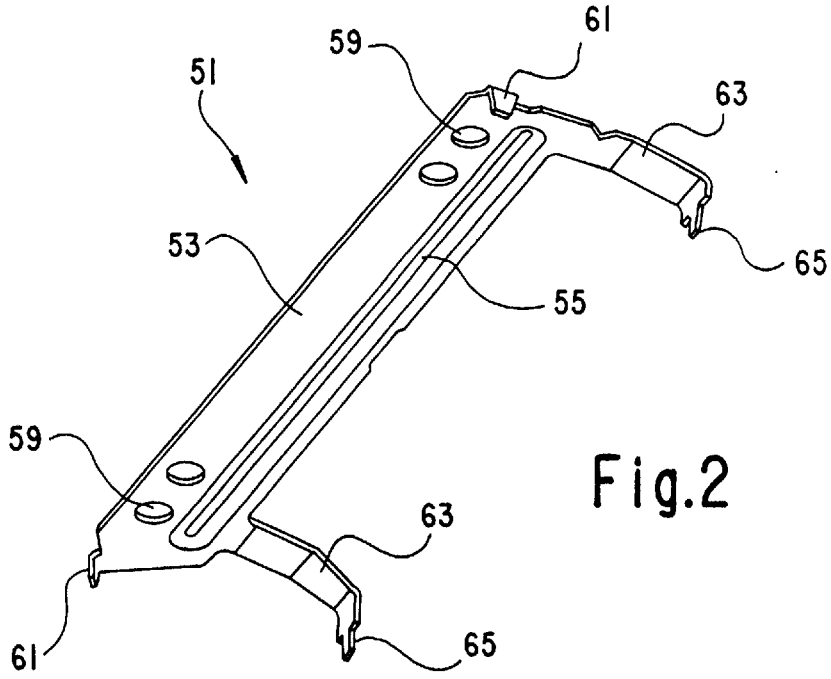
FIG. 2 is a perspective view of a heating-element positioning element of the cook top.

The cook top 1 described according to FIGS. 1 and 3 is assembled as now described. First, the decorative frame 3 is positioned with the top side of its decorative-frame cover panel 11, for example, on an assembly table (installation direction according to FIG. 3 or directional arrow in FIG. 1). Then the first and the second sealing beads 13, 15 are injected onto the underside of the decorative-frame panel 11, the underside being freely accessible from above. Thereafter, the glass-ceramic panel 7 is placed in a precisely positioned manner in the receiving space of the decorative-frame panel 11, the receiving space being bounded by the decorative-frame side wall 9. Furthermore, the adhesive-tape portions 17 are adhesively bonded around the periphery of the underside of the glass-ceramic panel 7, the underside projecting upward in the installation position. It is also the case that the silicone adhesive 19 is applied in the peripheral border region of the glass-ceramic panel 7 and in the border gap between the glass-ceramic panel 7 and the decorative-frame side wall 9 (FIG. 1). Thereafter, the installation frame 5 is placed, by way of its supporting shoulder 21, on the glass-ceramic panel 7 and/or the adhesive-tape portions 17. After this, pressure is exerted on the installation frame 5 uniformly over the surface of the glass-ceramic panel 7. As a result, around the periphery, the elastic adhesive-tape portions 17 are compressed slightly. In the next step, all the lugs 29, which are initially located in the plane of the decorative-frame side wall 9, are simultaneously positioned in the lug openings 27 of the side wall 23, 24 of the installation frame 5. Following this production step, the pressure of the installation frame 5 on the adhesive-tape portions 17 is eliminated. On account of the elastic properties of the adhesive-tape portions 17, the installation frame 5 is pushed away from the glass-ceramic panel 7 and the decorative frame 3 until the corresponding edges of the installation lugs 29 strike against the corresponding opening edges of the lug opening 27. In this position of the installation unit, the adhesive bead 19 sets, as a result of which the geometrical positioning of the frame parts 3, 5 and of the glass-ceramic panel 7 in relation to one another is defined in a permanent manner. In this case, the elasticity and the geometry of the second sealing bead 15 and of the decorative-frame panel 11 are coordinated with one another such that the decorative frame 11 butts, with all-round sealing, in an essentially gap-free manner against the top side of the glass-ceramic panel 7. The corresponding components are then inserted into the component openings 41 and secured therein (not shown). Furthermore heating elements 45 are placed into the base cutout 39 of the installation frame 5, onto the underside of the glass-ceramic panel 7, and are pressed against the latter in a precisely positioned manner by securing elements 51 which will be explained below (FIGS. 2, 3). Finally, the installation frame 5 is closed off on the base side by a cover (not shown).

For the production of the installation frame 5, basically the following steps are carried out in a suitable order. It should be noted here that first of all essentially the bending steps are carried out and only then are the installation openings for cook top components produced in accordance with the desired type of cook top which is to be produced. First of all the four installation-frame side walls 23, 24 are bent individually at right angles out of the plane of a sheet-metal panel. That surface region of the panel which then remains in the plane of the sheet-metal panel later forms the installation shoulder 37 of the installation frame 5. The supporting shoulders 21 are each bent at right angles from the end sections of the installation-frame side walls 23, 24. In order to complete the single-piece sheet-metal installation frame 5, which is produced by bending, the side walls 23, 24 are fixed to one another in the abutting border regions, in the region of the connecting lugs 33, by press joining or clinching (FIG. 1). In addition, in order to increase the rigidity of the installation frame 5, elongate profile regions are realized in the side walls 23 by bending. Thereafter, in dependence on the respectively desired type of cook top, the large-surface-area base cutout 39 and the component openings 41 are punched in a suitable manner out of the sheet-metal panel. Furthermore, the base panel is provided with thread indentations, in particular in order for it to be possible to close off the cook top 1 on the base side by the cover (not shown).

For the adjustment and/or positioning and installation of the heating elements 45 and/or of the heating-element casings 47, known per se, on the underside of the glass-ceramic panel 7, the heating-element casings 47 are placed into the stable structural unit which contains the frames 3, 5 and glass-ceramic panel 7 and has been preassembled as described above (FIG. 3). Provided on the base of the heating-element casings 47 are numerous numbered positioning openings 49 suitably spaced apart from one another on a circle in a manner known per se. The precise positioning of the heating-element casing 47 relative to the corresponding decorative printing, on the top side of the glass-ceramic panel 7, in a degree of inaccuracy in the range of less than 1 mm is realized as now described. For each heating-element casing 47, precisely one heating-device securing element 51 made of spring-steel material is fastened on the installation shoulder 37. The securing element 51 has a flat and elongate basic body 53. In order to increase its stability, a stamped formation 55 is provided over essentially its entire length. By screws 57, which project through corresponding screw-openings 59 of the securing element 51, the securing element 51 is fastened on the installation shoulder 37, in a longitudinal side of the installation frame 5. Provided at the two opposite end sections of the basic body 53 are positioning hooks 61 which are spaced as far apart as possible from one another and are bent at right angles from the basic body. These positioning hooks are inserted in correspondingly configured openings of the installation shoulder 37. In order to increase the positional accuracy, one of the essentially vertically downwardly projecting positioning hooks 61 is disposed at an angle of approximately 45° to the other positioning hook (FIGS. 2, 3). Furthermore, two arms 63, which are likewise spaced far apart from one another, project from the basic body 53 and project from the plane of the installation shoulder 37 and/or of the basic body 53 into the base cutout 39 of the installation frame 5. The arms 63 terminate in casing hooks 65 which engage in the corresponding positioning openings 49 of the base of the heating-element casing 47. As the spacing between the casing hooks 65 increases, the positional accuracy in relation to the heating-element casing 47 in the cook top 1 also increases. This spacing is typically approximately ½ of the diameter of the heating-element casing 47. In this case, the securing element 51 serves, on the one hand, for positioning and/or adjusting the heating-element casing 47 relative to the frame 3, 5 and/or the glass-ceramic panel 7 and, on the other hand, for pressing the heating-element casing 47 onto the underside of the glass-ceramic panel 7. This holding-down function can be enhanced by additional auxiliary devices provided in the cover of the installation frame 5, for example springs or stamped formations (not shown).

We claim:

1. A cook top, comprising:

a rectangular frame having an installation shoulder;

a cook top panel having a plurality of hot plates and secured on said rectangular frame;

a heating element secured beneath said cook top panel for heating said plurality of hot plates, said heating element having a heating element casing with positioning openings formed therein and a base, said installation shoulder of said rectangular frame extending substantially parallel to said base of said heating element casing; and a positioning element for positioning said heating element relative to said rectangular frame and secured in a precisely positioned manner on said installation shoulder, said positioning element having at least two spaced-apart connecting elements for engaging in two of said positioning openings of said heating-element casing of said heating element, said positioning element being an elongated plate having said at least two spaced-apart connecting elements, said at least two spaced-apart connecting elements being two fastening arms with casing hooks projecting from said elongated plate for engaging in said positioning openings of said heat-element casing.

2. The cook top according to claim 1, including at least one screw connection securing said positioning element to said rectangular frame.

3. The cook top according to claim 1, wherein said cook top panel has an underside, and said positioning element is formed of a spring-steel material and serves for positioning and pressing said heating-element casing onto said underside of said cook top panel.

4. The cook top according to claim 1, wherein said rectangular frame has a corner region and said positioning element is secured outside of said corner region.

5. The cook top according to claim 1, wherein said rectangular frame has a corner region and said positioning element is secured adjoining said corner region.

6. The cook top according to claim 1, wherein said cook top panel is made of a glass ceramic.

7. A cook top, comprising:

a rectangular frame having an installation shoulder;

a cook top panel having a plurality of hot plates and secured on said rectangular frame;

a heating element secured beneath said cook top panel for heating said plurality of hot plates, said heating element having a heating element casing with positioning openings formed therein and a base, said installation shoulder of said rectangular frame extending substantially parallel to said base of said heating element casing; and a positioning element for positioning said heating element relative to said rectangular frame and secured in a precisely positioned manner on said installation shoulder, said positioning element having at least two spaced-apart connecting elements for engaging in two of said positioning openings of said heating-element casing of said heating element, said installation shoulder of said rectangular frame having openings formed therein, and said positioning element having spaced-apart positioning hooks for engaging in said openings of said installation shoulder of said rectangular frame.

8. The cook top according to claim 7, including at least one screw connection securing said positioning element to said rectangular frame.

9. The cook top according to claim 7, wherein said cook top panel has an underside, and said positioning element is formed of a spring-steel material and serves for positioning and pressing said heating-element casing onto said underside of said cook top panel.

10. The cook top according to claim 7, wherein said rectangular frame has a corner region and said positioning element is secured outside of said corner region.

11. The cook top according to claim 7, wherein said rectangular frame has a corner region and said positioning element is secured adjoining said corner region.

12. The cook top according to claim 7, wherein said cook top panel is made of glass ceramic.

13. A cook top, comprising:

a rectangular frame having an installation shoulder;

a cook top panel having a plurality of hot plates and secured on said rectangular frame;

a heating element secured beneath said cook top panel for heating said plurality of hot plates, said heating element having a heating element casing with positioning openings formed therein and a base, said installation shoulder of said rectangular frame extending substantially parallel to said base of said heating element casing;

a positioning element for positioning said heating element relative to said rectangular frame and secured in a precisely positioned manner on said installation shoulder, said positioning element having at least two spaced-apart connecting elements for engaging in two of said positioning opeings of said heating-element casing of said heating element; and display and operating elements disposed in a front region of said cook top panel, said rectangular frame having two short longitudinal sides and a rear longitudinal side, and said positioning element being a plurality of positioning elements secured exclusively in said two short longitudinal sides and said rear longitudinal side of said frame.

14. The cook top according to claim 13, including at least one screw connection securing said positioning element to said rectangular frame.

15. The cook top according to claim 13, wherein said cook top panel has an underside, and said positioning element is formed of a spring-steel material and serves for positioning and pressing said haeting-element casing onto said underside of said cook top panel.

16. The cook top according to claim 13, wherein said rectangular frame has a corner region and said positioning element is secured outside of said corner region.

17. The cook top according to claim 13, wherein said rectangular frame has a corner region and said positioning element is secured adjoining said corner region.

18. The cook top according to claim 13, wherein said cook top panel is made of a glass ceramic.

* * * * *